US006550577B1

(12) United States Patent
Allgire

(10) Patent No.: US 6,550,577 B1
(45) Date of Patent: Apr. 22, 2003

(54) LADDER SECURING DEVICE

(76) Inventor: Billie J. Allgire, 744 W. 500 South, Provo, UT (US) 84601

( * ) Notice: Subject to any disclaimer, the term of this patent is extended or adjusted under 35 U.S.C. 154(b) by 0 days.

(21) Appl. No.: 09/994,995

(22) Filed: Nov. 21, 2001

(51) Int. Cl.[7] ..... E06C 7/42

(52) U.S. Cl. ..... 182/107; 182/129; 248/211; 248/500

(58) Field of Search ..... 182/107, 121, 182/214, 129, 230, 206, 229, 116, 93; 248/210, 211, 231.91, 238, 500

(56) References Cited

U.S. PATENT DOCUMENTS

| | | | | |
|---|---|---|---|---|
| 1,252,224 A | | 1/1918 | Bittner | |
| 1,982,572 A | * | 11/1934 | Colglazer et al. | 182/107 |
| 2,685,957 A | | 8/1954 | Schlesinger | |
| 4,164,269 A | * | 8/1979 | Jackson | 182/107 X |
| 4,257,492 A | * | 3/1981 | Rasada, Jr. et al. | 182/93 X |
| 4,545,460 A | * | 10/1985 | Byrd | 182/107 |
| 4,643,275 A | * | 2/1987 | Le Blanc | 182/107 |
| 4,678,061 A | | 7/1987 | Jordan et al. | |
| 4,765,439 A | | 8/1988 | Kresmery | |
| 4,770,373 A | * | 9/1988 | Salo | 182/93 X |
| 4,792,016 A | * | 12/1988 | Ingalsbe et al. | 182/107 |
| D307,384 S | | 4/1990 | Phillips | |
| 4,924,971 A | * | 5/1990 | Rice | 182/93 |
| 5,012,895 A | | 5/1991 | Santos | |
| 5,358,071 A | * | 10/1994 | Stennett | 182/214 |

* cited by examiner

*Primary Examiner*—Daniel P. Stodola
*Assistant Examiner*—Hugh B. Thompson
(74) *Attorney, Agent, or Firm*—Jones, Waldo, Holbrook & McDonough; Michael W. Starkweather

(57) ABSTRACT

A safety device, for securing a ladder to more than one structure type. The device includes a base, having one or more connection holes, designed to secure the safety device to a first structure type through the connection holes. The device also includes a securing section, coupled to the base section, designed to secure the safety device to a second structure type. The device may optionally include a support, removably coupled to the base, designed to engage a front edge of a gutter, to prevent structural damage to the gutter when the ladder rests on the gutter. The device may also include a removable bracket portion, having one or more bracket connection holes, perpendicularly oriented to, and coupled to, the base, and designed to secure the safety device to a third structure type, through the bracket connection holes, when the support engages the front edge of the gutter.

18 Claims, 6 Drawing Sheets

LADDER SECURING DEVICE

BACKGROUND

In commercial construction, as well as in home improvement, ladders are frequently used to scale structures such as buildings. Repeated upward, downward and lateral movement of users may, at times, cause the ladder to slip or move. Such movement could potentially damage the structure or nearby property. More importantly, this sort of movement could cause the user to fall, resulting in serious injury. A device for securing a ladder, thereby preventing its movement, may therefore be desirable.

In securing a ladder, it is also important that the securing device be adaptable to a wide range of structures. For example, in some circumstances, it is preferable to fasten the securing device to the structure with a screw or nut and bolt assembly. However, in some circumstances, less invasive means of securing would be preferred. A device for securing a ladder that is adaptable to a wide range of structures, may therefore be desirable.

Another important consideration when using a ladder is the impact of the ladder on the structure. For example, when the structure being scaled is a building having rain-insulation devices, such as flashing drip-edges and gutters, these features can be significantly damaged by the placement of the ladder thereupon. A device that may minimize the impact of the ladder on the structure would therefore be desirable.

A number of prior patents disclose devices for securing ladders either to the ground, or to a nearby structure, thus preventing movement during use. Examples of these patents, each of which is incorporated by reference for its supporting teachings, are as follows:

U.S. Pat. No. 5,012,895 to Santos discloses adjustable extensions for enhancing the safety of a ladder. These extensions can be attached to the bottom ends of the side rails of the ladder so as effectively to adjust the lengths of such rails so that the ladder will not lean to either side, regardless of any difference in heights of the ground or support areas under such rails. Also, coupling cables couple the ladder to the wall of the building against which the ladder leans. The coupling cables connect the midpart of the ladder to a horizontal wall cable which is attached along and parallel to the wall of the building. The top of the ladder is stabilized against rolling to either the left or right and so that it can be positioned stably against irregular supports, such as windows, eaves, pitched roofs, pipes, etc., by means of stabilizing bars connected to its top and suitably shaped to mate with the irregular supports, and by extension arms which project out from the top of the ladder. Hand holds are attached to the extension arms.

U.S. Design Patent No. Des. 307,384 discloses an ornamental design for a ladder hook.

U.S. Pat. No. 4,765,439 to Kresmery discloses a device for retaining the upper end of a ladder to a building parapet wall or the like to securely, temporarily hold the ladder. The device is provided with a frame which is temporarily attached to the ladder and projects outwardly therefrom to extend over the building parapet wall. A clamp is attachable to the frame in various positions to entrap the parapet wall between the clamp and the ladder preventing a relative movement thereof.

U.S. Pat. No. 4,678,061 to Jordan, et al. discloses a ladder roof brace which includes adjustable means of engaging the rungs of a ladder, means of bearing against both sides of a roof over a ridge and means of engaging a gutter.

U.S. Pat. No. 2,685,957 to Schlesinger discloses a conveyor assembly for converting a ladder having side rails and rungs into a conveyor frame, a bucket guide, brackets and spring strips.

U.S. Pat. No. 1,252,224 to Bittner discloses a ladder support having a shank provided at its ends with oppositely disposed hooks which lie at the opposite sides of the shank, a clip adjustably mounted on the shank, means for securing the clip and a prong mounted on one end portion of the shank.

While the foregoing patents disclose improvements in the area of ladder safety, none of these patents disclose a ladder securing device that prevents movement of the ladder, which is also adaptable to a wide range of structures and minimizes the impact of the ladder on the structure.

SUMMARY OF THE ILLUSTRATED EMBODIMENT OF THE INVENTION

There is therefore provided a safety device, for securing a ladder to more than one structure type. The device includes a base, having one or more connection holes, designed to secure the safety device to a first structure type through the connection holes. The device also includes a securing section, coupled to the base section, designed to secure the safety device to a second structure type.

The device may optionally include a support, removably coupled to the base, designed to engage a front edge of a gutter, to prevent structural damage to the gutter when the ladder rests on the gutter. The device may also include a removable bracket portion, having one or more bracket connection holes, perpendicularly oriented to, and coupled to, the base, and designed to secure the safety device to a third structure type, through the bracket connection holes, when the support engages the front edge of the gutter.

A method of securing a ladder to a structure is also provided. In this method a securing device is provided. The securing device has a base, having one or more connection holes thereon, designed to secure the device to a first structure type; a hooking section, coupled to the base, designed to secure the device to a second structure type; and a buckle, rotatably coupled to the base.

It is determined whether the structure is the first or second structure type, and if the structure is the first structure type, the base is attached thereto. Alternatively, if the structure is the second structure type, the hooking section is attached thereto. A strap is coupled between the buckle and a ladder rung. Thus, the ladder is secured to the structure.

BRIEF DESCRIPTION OF THE DRAWINGS

The present invention will be understood more fully from the detailed description given below and from the accompanying drawings of the preferred embodiment of the invention, which, however, should not be taken to limit to the invention, but are for explanation and understanding only.

DETAILED DESCRIPTION OF THE ILLUSTRATED EMBODIMENT(S)

Figure 1:
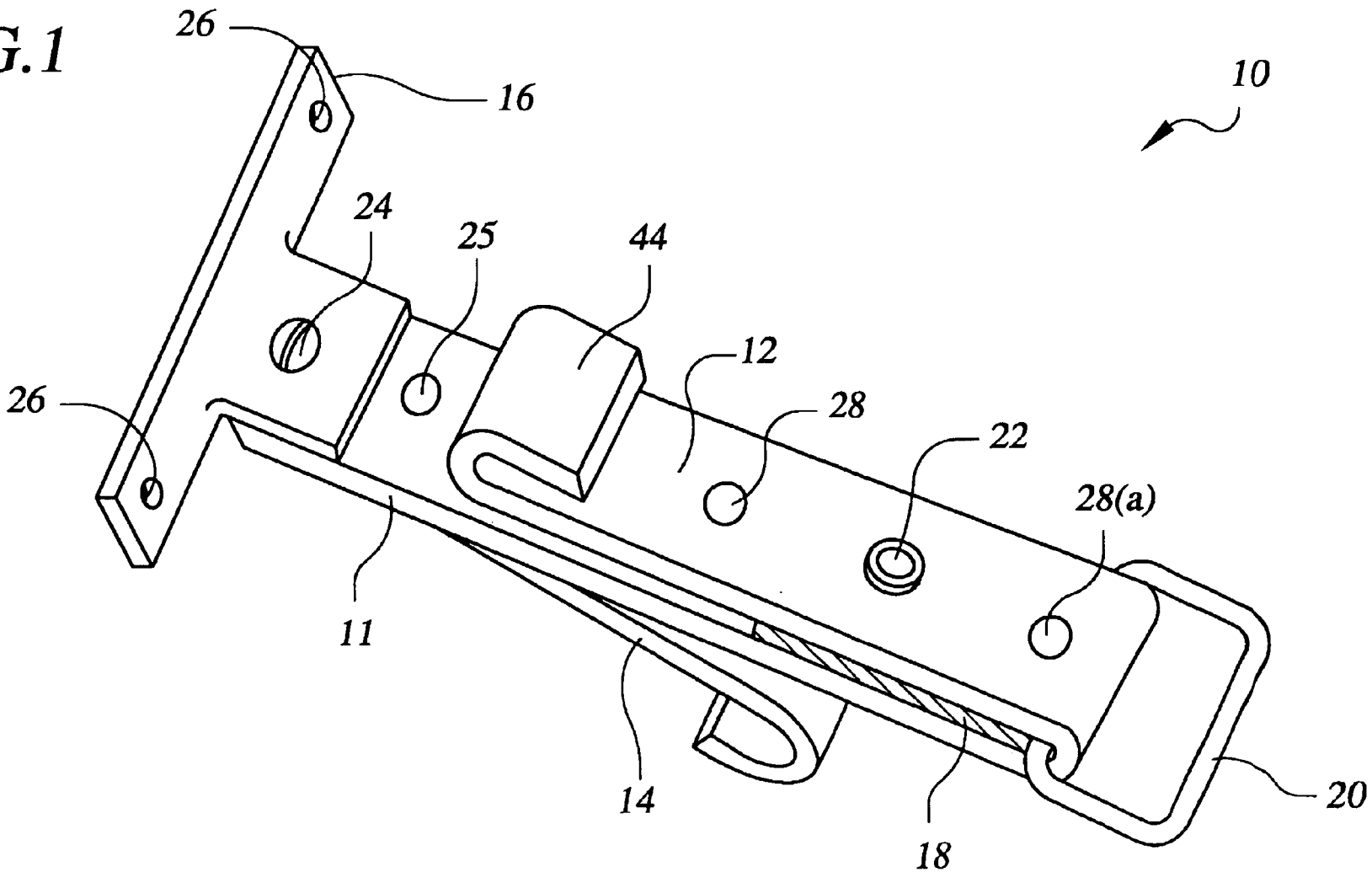
FIG. 1 is an oblique elevational perspective view of an embodiment of a ladder securing device according to the present invention.
Figure 2:
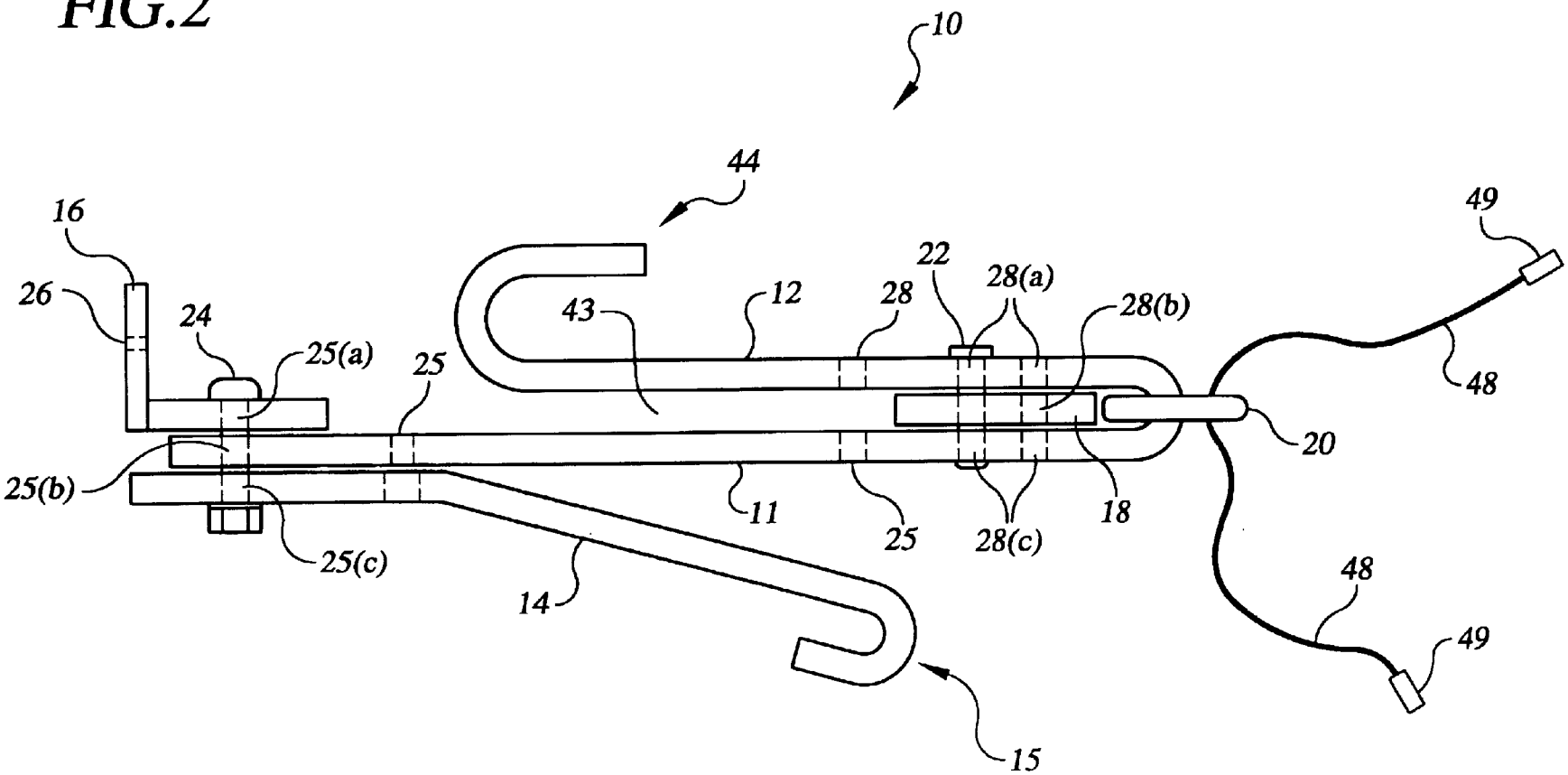
FIG. 2 is a side view of the ladder securing device in FIG. 1.
Figure 3:
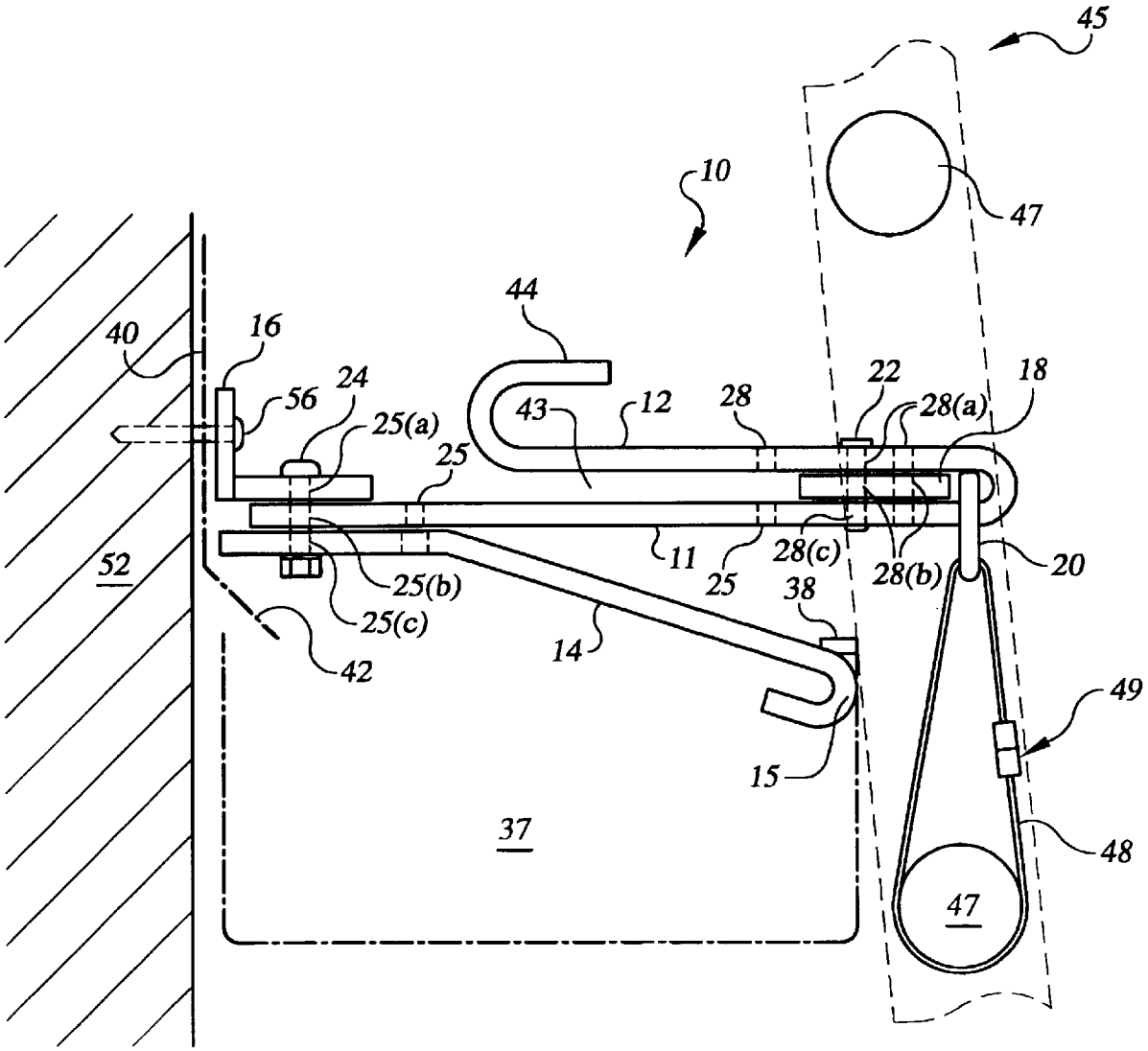
FIG. 3 is a side view of the ladder securing device in FIG. 1 illustrating its operation.

Referring generally to FIGS. 1–3, there is shown a safety device 10 for securing a ladder to a structure 52; Generally, the device 10 includes a base 11. Coupled to the base 11 through common connection holes 25(*a*)–(*c*) are support section 14 and bracket portion 16. Also coupled to the base 11 is a securing section 12 and a buckle 20.

The base 11, securing section 12, and bracket 16 are each designed to secure a ladder 45 (FIG. 3) to a structure 52 (FIG. 3) under at least three sets of circumstances. Specifically, the bracket 16 is well suited for securing a ladder 45 to a structure having rain gutters 37. The base 11 can be used to secure a ladder 45 to a structure 52 having water insulating materials 40, such as flashing. The securing section 12 is well suited to secure a ladder 45 to a structure 52 having a hookable edge 52(*a*) (FIG. 6), and where it may be desirable to avoid screwing or nailing the device 10 to the structure 52.

Figure 4:
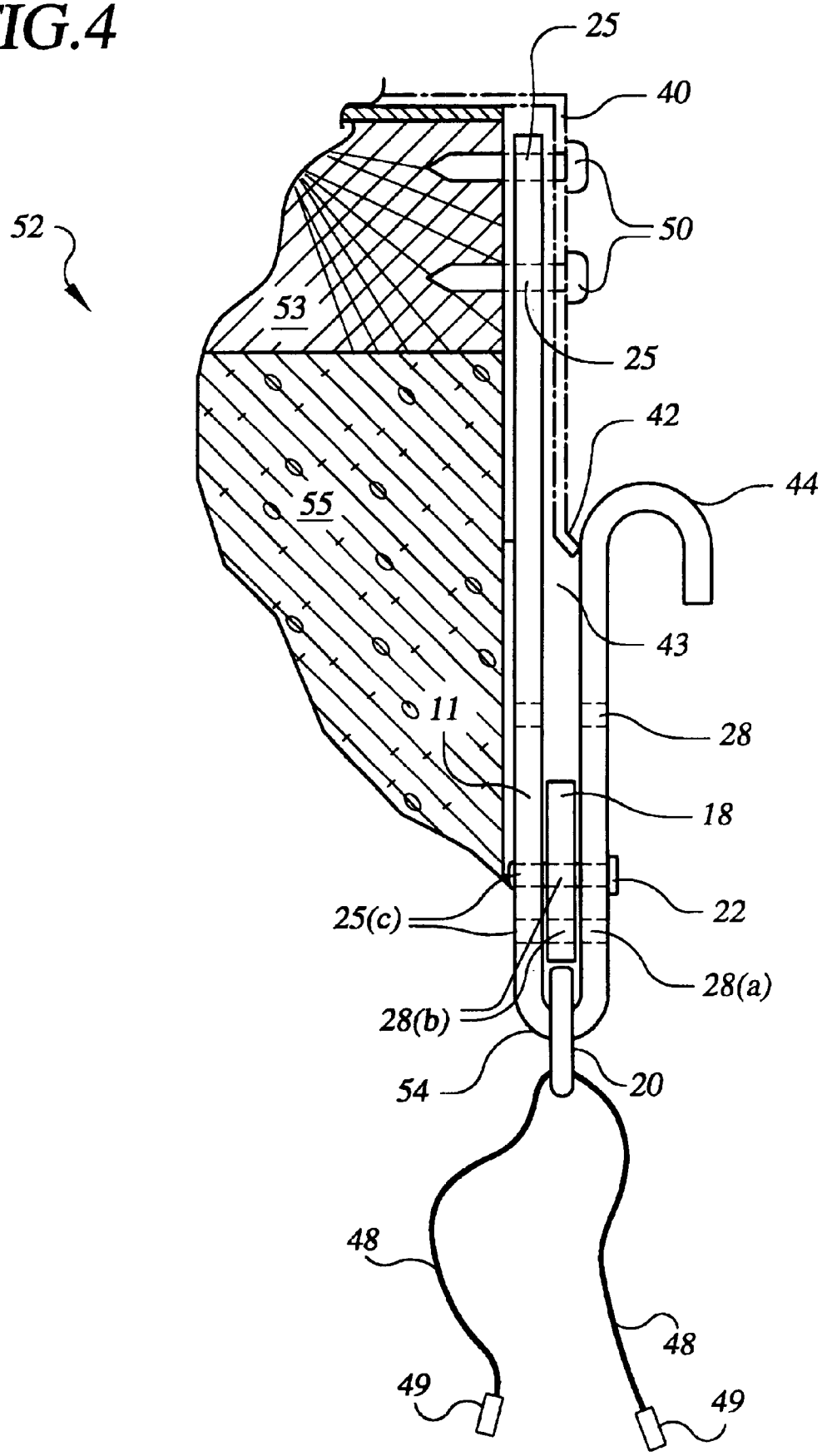
FIG. 4 is a side view of an embodiment of a ladder securing device.

With respect to the base 11, as depicted in FIG. 4, the base 11 can be inserted underneath water insulating material such as flashing 40. Through the connection holes 25, one or more connectors 50 fastens the base 11 to the structure 52. The device 10 is fastened by screws 50 driven through the flashing 40, through the connection holes 25, and into an underlying wood support 53.

Once the device 10 is secured to the structure 52, a strap 48, coupled to the buckle 20, may then be attached to a rung 47 on a ladder 45 (FIG. 3). It is noted that, rather than creating new holes in the water insulating materials (e.g. the metal flashing 40), the existing holes, already securing these materials to the structure 52, can be utilized. In this manner, the ladder 45 can be secured to the structure 52 without significantly damaging the water insulating materials 40. Moreover, the base 11 can include multiple connection holes 25, thus better accommodating potentially diverse locations of existing holes in the water insulation 40.

As can also be seen in FIG. 4, the drip edge 42 of the flashing 40 may be tucked in the space 43 between the base 11 and the securing section 12. This configuration provides the added advantage of protecting the drip edge 42 from structural damage caused by a ladder 45 resting against it. The width of the space 43 can be adjusted to accommodate drip edges 42 of various sizes.

It is noted that while FIG. 4 shows the present invention being utilized with a wood 53 and concrete 55 structure, the device 10 can be used with numerous structure types of various materials, including all concrete or all wood structures. It would be apparent to one skilled in the art that depending on the structure material, different types of connectors 50 would need to be used. For example, for an all concrete structure, concrete screws would be used.

Figure 5:
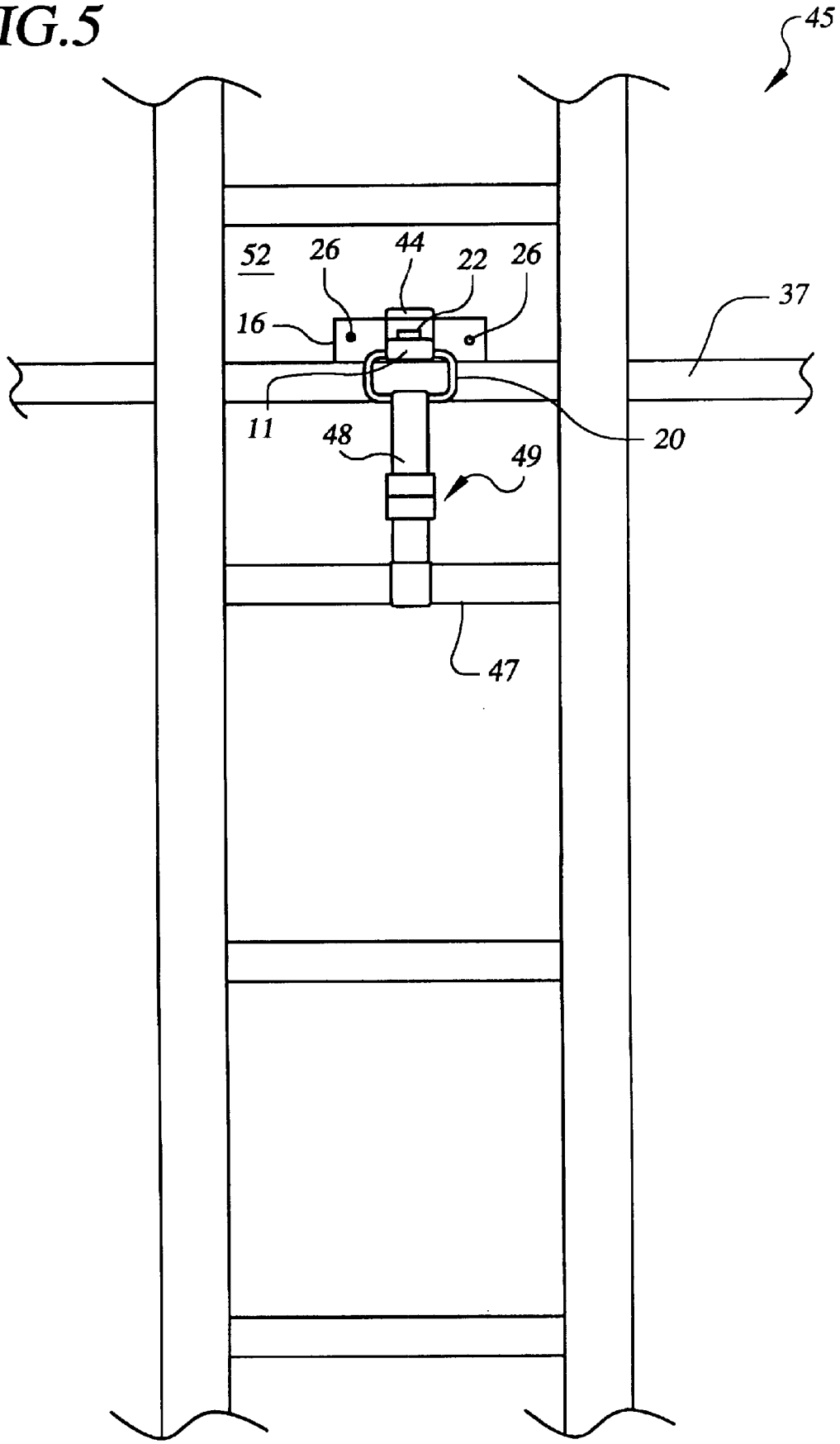
FIG. 5 is a front view of a ladder securing device according to the present invention.
Figure 6:
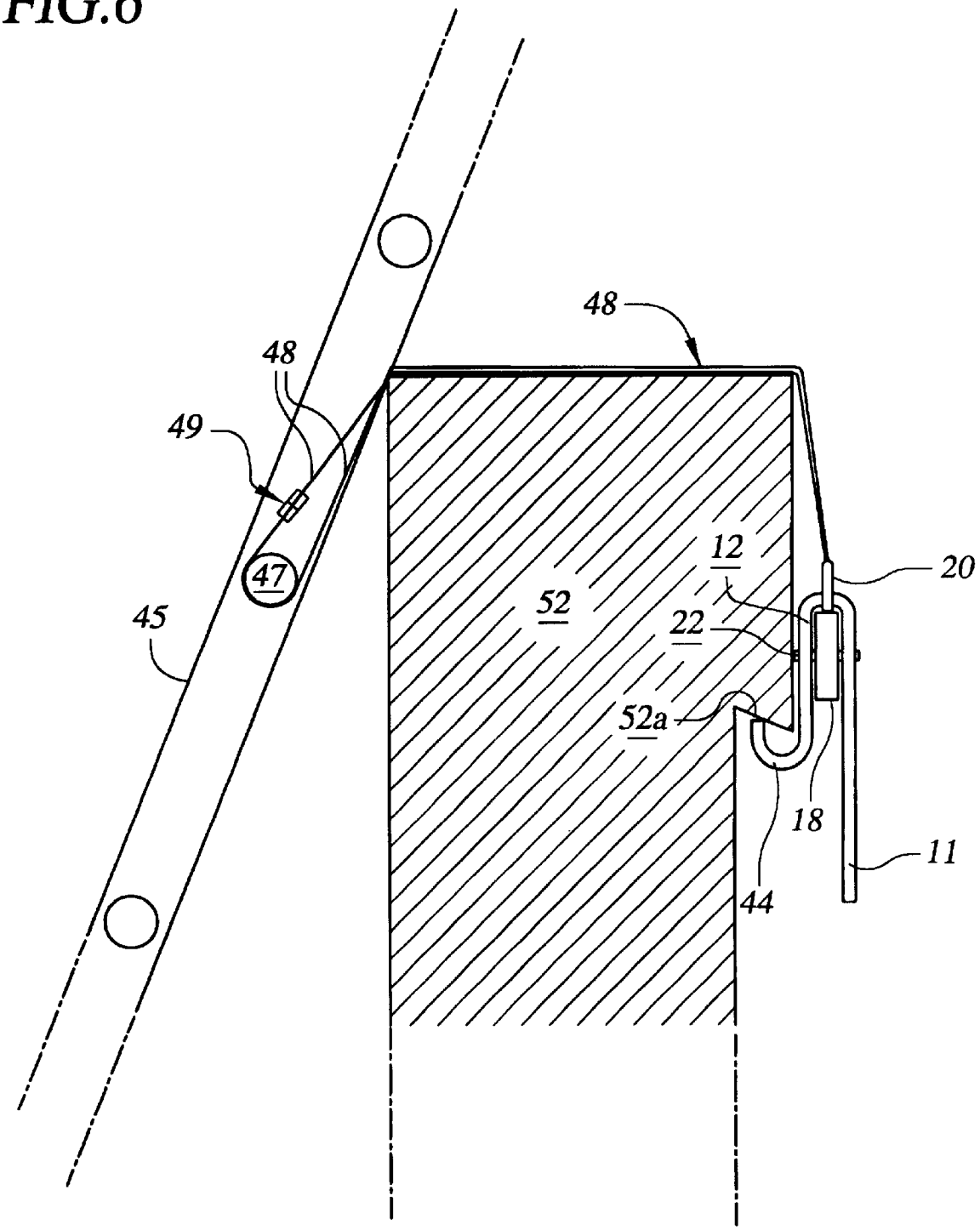
FIG. 6 is a side view of the ladder securing device secured to a structure having a hookable edge.

In the embodiment shown in FIGS. 1–6, the securing section 12 is substantially hook shaped. This configuration allows the securing section 12 to engage a structure 52 by "hooking" it. For example, in FIG. 6 is shown a second type of structure 52 having a hookable edge 52(*a*). The securing section 12 closely engages the edge 52(*a*), thereby securing the device 10 to the structure 52.

Once the device 10 is secured to the structure 52, a strap 48 may then be coupled between the buckle 20 and a ladder rung 47, thereby securing the ladder 45 to the structure 52.

As seen in FIG. 3, a support 14 can also be removably coupled to the base 11. The support 14 is designed to engage a front edge 38 of a rain gutter 37, to prevent structural damage to the gutter 37 when the ladder 45 rests on the gutter 37. The support 14 can be coupled to the base 11 through a common connection hole 25(*a*)–(*c*). In FIG. 3, this connection is made by a nut and bolt assembly 24.

In one embodiment, connection hole 25(*c*) is slotted. Thus, the support 14 is slidably coupled to the base 11. The slidable coupling allows the support 14 to be positioned backwards or forwards depending on the width of the gutter 37, or the gutter's position relative to the structure 52. In other words, if the gutter 37 is unusually wide, or if it is positioned a distance away from the structure 52, the nut and bolt coupling 24 can be loosened, and the support 14 slid forward relative to the base 11. In this manner, the front end 15 of the support 14 can closely engage the front edge 38 of a wide variety of gutter 37 configurations.

As best seen in FIG. 3, when the support 14 is used, the device 10 can be attached to the structure 52 by a removable bracket 16. In one embodiment, the removable bracket 16 is coupled to the base 11 and support 14 through common connection holes 25(*a*)–(*c*). The bracket portion 16 has a perpendicular orientation relative to the base 11. The bracket 16 has one or more bracket connection holes 26 (FIGS. 1–2) through which the device 10 can be secured to a third structure type having rain gutters 37. The bracket 16 is primarily needed when the support 14 is being used to prevent gutter 37 damage caused by the ladder 45.

The buckle 20, as noted above, can be rotatably coupled to the base 11. Typically, a strap 48 is attached to the buckle 20. The strap 48 is also coupled to a rung 47 on a ladder 45. The straps 48 could be fastened by any conventional means. For example, in FIGS. 1–6, the straps are shown as having strap buckles 49.

In FIGS. 1–4 and 6, a separator 18 is shown coupled between the base 11 and securing section 12. In this embodiment, the separator 18 is coupled to the base 11 and securing section 12 by a welded screw 22 through common connection holes 28(*a*)–(*c*). The separator 18 provides, among other advantages, a means to secure the buckle 20 to the base 11. It is noted that, in other embodiments, additional separators 18 can be used.

FIG. 5 illustrates the operation of the device 10 on a structure 52 having a rain gutter 37. As is evident from the figure, the bracket portion 16 is secured to the structure 52 through bracket connection holes 26. A strap 48 then couples the ladder rung 47 to the buckle 20, which, along with the bracket 16, is coupled to the base 11.

Variations of the Invention

In FIGS. 1–4 and 6, the hooking end 44 of the securing section 12 is a rounded protrusion. However, it is noted that several configurations could accomplish the "hooking" action, and are considered to be within the scope of the present invention. For example, rather than being rounded, the hooking end 44 could be an angled protrusion.

It is also noted that the end 15 of the support 14 could also be configured in a variety of ways. In the embodiments shown in FIGS. 1–3, the end 15 is substantially hook-shaped. However, the end 15 could simply terminate without the hook. Additionally, the end 15 could include a ball, or other enlargement, that would aid in snug engagement of the gutter's edge 38. Numerous other configurations would be apparent to one skilled in the art.

It is also noted that, in FIGS. 1–4 and 6, the base 11 and securing section 12 are shown as one continuous piece of material, separated by a bend in the material. However, it is not necessary that the base 11 and securing section be forged from the same piece. For example, in one embodiment, the base 11 is one piece and the securing portion 12 is welded thereto. Numerous other means of coupling the base 11 to the securing section 12 would be apparent to one skilled in the art.

In FIGS. 1–4 and 6, the buckle 20 is shown situated in the bend between the base 11 and the securing section 12. However, the buckle 20 could be coupled to the base 11 in any number of ways that would be apparent to one skilled in the art.

Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function, manner of operation, assembly, and use may be made without departing from the principles and concepts set forth herein.

What is claimed is:

1. A safety device, for securing a ladder to more than one structure comprising:

a) base, having one or more connection holes placed thereon, adapted to secure the safety device to a first structure through the connection holes;

b) a securing section, coupled to the base section, adapted to secure the safety device to a second structure;

c) a buckle, rotatably coupled to the base section;

d) a support, removably coupled to the base, adapted to engage a front edge of a gutter, to prevent structural damage to the gutter when the ladder rests on the gutter; and e) a removable bracket portion, having one or more bracket connection holes, perpendicularly oriented to, and coupled to, the base, and adapted to secure the safety device to a third structure, through the bracket connection holes, when the support engages the front edge of the gutter.

2. The device of claim 1, further comprising a strap, coupled to the buckle, and adapted to attach to a ladder rung.

3. The device of claim 1, wherein the base, the support, and the removable bracket portion are coupled together by a connector through a common connection hole.

4. The ladder securing device of claim 1, further comprising a separator, coupled between the base and securing section.

5. The ladder securing device of claim 1, wherein the securing section is substantially shaped as a hook.

6. The ladder securing device of claim 1, wherein the base has at least two connection holes.

7. A safety device, for securing a ladder to more than one structure, comprising:

a) a base, having one or more connection holes, adapted to secure the safety device to a first structure through the connection hole, and a buckle rotatably coupled to the base; and b) a securing section, coupled to the base section, adapted to secure the safety device to a second structure, and c) a strap, coupled to the buckle, and adapted to attach to a ladder rung.

8. The ladder securing device of claims 7, wherein the securing section is substantially shaped as a hook.

9. The ladder securing device of claim 7, further comprising a separator, coupled between the base and the securing section.

10. The device of claim 7, further comprising a support, removably coupled to the base, adapted to engage a front edge of a gutter, to prevent structural damage to the gutter when the ladder rests on the gutter.

11. The device of claim 10, further comprising a removable bracket portion, having one or more bracket connection holes, perpendicularly oriented to, and coupled to, the base, and adapted to secure the safety device to a third structure through the bracket connection holes, when the support engages the front edge of the gutter.

12. The device of claim 11, wherein the base, the support, and the removable bracket portion are coupled together by a connector through a common connection hole.

13. A method of securing a ladder to a structure, comprising the steps of:

a) providing a securing device, having:

i) a base, having one or more connection holes thereon, adapted to secure the device to a first portion of the structure;

ii) a hooking section, coupled to the base, adapted to secure the device to a second portion of the structure type; and iii) a buckle, rotatably coupled to the base;

b) attaching the base or the hooking section to the first portion of the structure;

c) alternatively attaching the hooking section to the second structure; and d) coupling a strap between the buckle and a ladder rung.

14. The method of claim 13, wherein the step of attaching the base further comprises the steps of:

a) inserting the base beneath a drip edge on the first portion of the structure; and b) attaching the base to the structure with a connector through the connection holes.

15. The method of claim 14, wherein the drip edge is flashing.

16. The method of claim 13, wherein the base has at least two connection holes.

17. The method of claim 13, wherein the step of attaching the hooking section further comprises the steps of:

a) locating a hookable edge on the second portion of the structure type;

b) engaging the hookable edge with the hooking section.

18. The method of claim 13, wherein the securing section is substantially shaped as a hook.

* * * * *